United States Patent [19]

Campbell

[11] 4,078,263

[45] Mar. 7, 1978

[54] MANUALLY OPERATED MOBILE MIXER

[76] Inventor: Lloyd F. Campbell, 42 65th Pl., Long Beach, Calif. 90803

[21] Appl. No.: 786,226

[22] Filed: Apr. 11, 1977

[51] Int. Cl.[2] ..... B28C 5/20

[52] U.S. Cl. ..... 366/53; 366/228; 366/233

[58] Field of Search ..... 259/175, 176, 177 R, 259/81 R, 3, 14, 30, 57, 89; 214/355

[56] References Cited

U.S. PATENT DOCUMENTS

| | | | |
|---|---|---|---|
| 1,307,803 | 6/1919 | Shero | 259/176 |
| 2,599,852 | 6/1952 | McClain | 259/177 |
| 3,326,537 | 6/1967 | Wallace | 259/177 |
| 3,578,292 | 5/1971 | Montague | 259/177 |
| 3,655,168 | 4/1972 | Lord | 259/177 |

*Primary Examiner*—Robert W. Jenkins
*Attorney, Agent, or Firm*—Fulwider, Patton, Rieber, Lee & Utecht

[57] ABSTRACT

A manually operated mobile mixer having a wheeled base and a handle for rolling the base over a supporting surface. A pivot on the base rotatably engages the bottom of a cylindrical mixing container whose exterior surface frictionally engages a pair of wheels on the base. Rolling the base on its wheels rotates the container and mixes materials within the container. The container can be removed and carried to the work area.

5 Claims, 6 Drawing Figures

FIG. 1
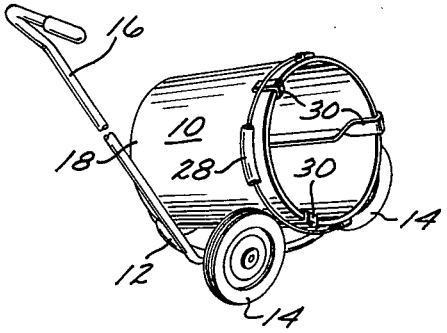
FIG. 2
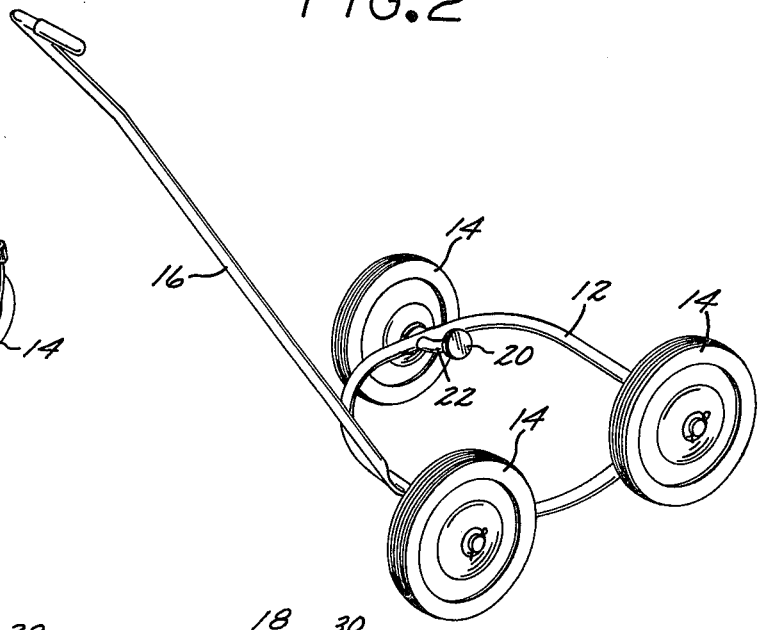
FIG. 3
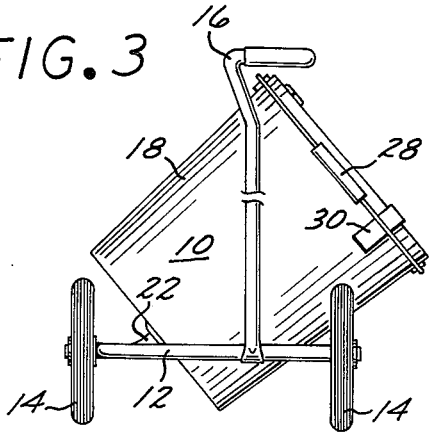
FIG. 4
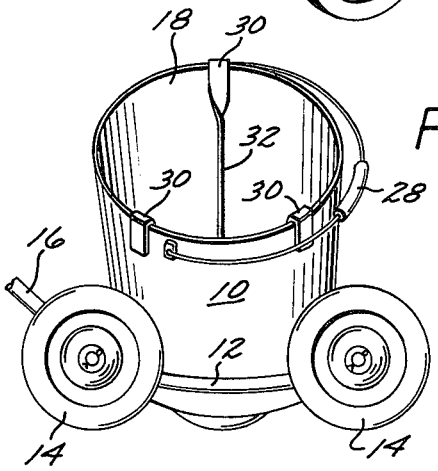
FIG. 5
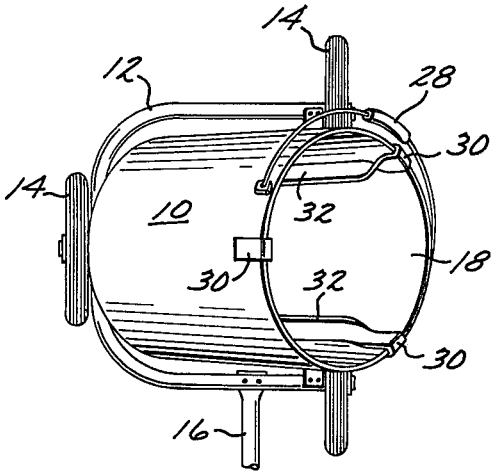
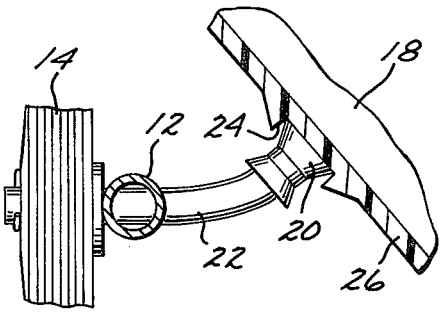
FIG. 6

MANUALLY OPERATED MOBILE MIXER

BACKGROUND OF THE INVENTION

1. Field of the Invention

The present invention relates to a manually operated mixer which is mobile, and in which the mixing container can be removed and carried to the work area.

2. Description of the Prior Art

It is often necessary for individuals such as home owners to mix small batches of cement and aggregate for odd jobs around the home. Most commonly this is done by placing the materials to be mixed in a wheel barrel or on a flat surface and shoveling the materials together until mixing has been achieved. This can be a messy chore because the materials are often spattered about the mixing area and the spatters, wheel barrel, carrying container, shovel, and the like must all be scrupulously hosed down or washed off before the materials set up as hardened concrete. If an electric mixer is used, there is the added hazard of electrical shock to persons working in the vicinity of the mixer, particularly when water is present.

If the odd job or task requires use of cement in the house, most home owners do not attempt to mix the materials at the job site. Instead, the materials are mixed elsewhere and are laboriously carried to the job site.

SUMMARY OF THE INVENTION

According to the present invention, a manually operated mobile mixer is provided which includes a wheeled base having a handle for rolling the base over a supporting surface. The mixer includes a cylindrical mixing container whose exterior surface is frictionally engaged upon a pair of the wheels supporting the base. The pivot on the base engages the bottom of the container and supports it in an inclined position.

The materials to be mixed are placed in the container and the base is rolled back and forth to rotate the container and thereby mix the materials. The container may be provided with internal baffles having surfaces oriented to engage and tumble the materials being mixed.

Although the present mixer has particular utility in connection with the mixing of cement and aggregate, it is also applicable to the mixing of small quantities or batches of other materials, such as plaster, tile, grout, seed, mulch, feed, roof coatings, paint, and resin-catalyst-accelerator combinations.

Other objects and features of the invention will become apparent from consideration of the following description taken in connection with the accompanying drawings.

BRIEF DESCRIPTION OF THE DRAWINGS

FIG. 1 is a perspective view of the present mixer;

FIG. 2 is a view of the mixer with the mixing container removed;

FIG. 3 is a front elevational view of the mixer of FIG. 1;

FIG. 4 is a side elevational view of the mixer of FIG. 1;

FIG. 5 is a top plan view of the mixer of FIG. 1; and

FIG. 6 is an enlarged detail view, partially in cross section, of the pivot which pivotally or rotatably supports the mixing container upon the base.

DESCRIPTION OF THE PREFERRED EMBODIMENT

Referring now to the drawings, there is illustrated a manually operated mobile mixer 10 according to the present invention and comprising, generally, a base 12 having three wheels 14 and including a handle 16 for rolling the base 12 on the wheels 14 over a supporting surface such as the ground or a floor. The mixer 10 also comprises a cylindrical mixing container 18 having its exterior surface in frictional engagement with a pair of the wheels 14. A pivot 20 on the base 12 rotatably supports the container 18 so that rolling of the base 12 causes rotation of the container 18 and mixing of materials in the container.

The weight of the materials in the container 18 tends to maintain the frictional engagement between the pair of wheels 14 and the exterior surface of the container 18.

The base 12 is preferably made of tubular metal formed in a generally D-shape configuration, with a pair of the wheels 14 being rotatably mounted to adjacent corners of the base 12, as best illustrated in FIG. 2. That portion of the base 12 extending between the pair of wheels 14 is preferably downwardly formed in an arcuate configuration to provide sufficient clearance for the container 18 to rest against the adjacent wheels 14.

The third wheel 14 is mounted on the opposite side of the base 12, generally midway between the rounded extremities of that side of the base. As best seen in FIG. 6, a tubular projection or mount 22 is attached to the base 12 adjacent the single wheel 14 on that side. The pivot 20 is rotatable upon the inwardly projected extremity of the mount 22 and is received within a circular recess 24 formed within the bottom 26 of the container 18. The complemental portions of the pivot 20 and recess 24 are maintained in engagement by the weight of the materials in the container 18.

The location and orientation of the mount 22, the diameter and height of the container 18, and the diameter and spacing of the adjacent pair of wheels 14 are selected such that the container 18 cannot touch the surface over which the mixer 10 is rolled. In addition, the container 18 is inclined with respect to a vertical axis such that the pair of wheels 14 are adapted to engage and rotate the container 18 without any contact between the container 18 and any portion of the base 12 except the wheels 14 and the pivot 20.

The container 18 is preferably made of a durable plastic material or the like and is provided with the usual bail 28 so that it can be lifted off the base 12 and transported independently of the base.

The container 18 is preferably provided with a plurality of elongated baffles 30 having their upper extremities hooked over or otherwise engaged upon the upper end or rim of the upwardly open container 18. Each baffle 30 is conveniently made of a flat strip of metal or plastic which is twisted to provide a portion 32 extending radially inwardly of the wall of the container 18 to facilitate tumbling of the materials being mixed.

The elongated handle 16 is preferably hinged at its point of connection to the base 12. This allows the handle to be folded inwardly for compact storage of the mixer 10.

The materials to be mixed are placed in the container 18 in the proper proportions. In a typical application, such as the mixture of cement and aggregate, a five gallon container 18 is used. It is filled with approximately a gallon, by volume, of the materials, which weigh close to 25 pounds. This had been found to provide enough weight to develop sufficient friction between the wheels 14 and the surface of the container 18 to rotate the container when the base 12 is rolled back and forth.

If desired, the sides of the container 18 and the complemental portions of the rims of the wheels 14 could be ribbed or ridged or otherwise formed to develop a more positive drive. However, a solely frictional engagement has been found to operate satisfactorily and is preferred for its simplicity.

When the materials have been mixed to the proper consistency the container 18 can be carried to the work area. However, the mixer 10 is light in weight and relatively compact so that it can be operated at the work site. The mixer is easily moved about and stored and presents no danger around water because no electricity is needed for its operation. The expense and complexity of drive chains, motors and the like is completely eliminated.

An unexpected advantage of the frictional drive for the container 18 is that for certain materials the container 18 begins to slip on one or more of the wheels 14 when the materials are properly mixed. For example, if cement and aggregate are being mixed, the mixture becomes much more viscous at about the time it is properly mixed. More of the mixture then rides or climbs up one side of the container 18. The side on which this occurs depends upon the direction the mixer 10 is being moved over the floor or ground. The off-center mass of the mixture then causes the container 18 to more forcefully engage one wheel and slip on the other, thereby signally that the mixing is at or near completion.

Various modification and changes may be made with regard to the foregoing detailed description with departing from the spirit of the invention.

I claim:

1. A manually operated mobile mixer comprising:

a base having wheels and including a handle for rolling said base on said wheels over a supporting surface;

a cylindrical mixing container having its exterior surface in engagement with a pair of said wheels; and pivot means on said base rotatably supporting said container whereby rolling said base over said supporting surface effects rotation of said container and mixing of materials therein, the weight of said materials tending to maintain said engagement.

2. A manually operated mobile mixer according to claim 1 wherein said pivot means rotatably engage the bottom of said container and orient said container in inclined relation to a vertical axis.

3. A manually operated mobile mixer according to claim 1 wherein said engagement between said container and said pair of wheels is solely frictional.

4. A manually operated mobile mixer according to claim 1 wherein said container includes internal baffles having portions extending radially inwardly to facilitate tumbling of said materials to be mixed.

5. A manually operated mobile mixer according to claim 4 wherein each of said baffles comprises an elongated element removably hooked at one extremity to the upper end of said container.

* * * * *